US005810621A

United States Patent [19]

Tsai

[11] Patent Number: 5,810,621

[45] Date of Patent: Sep. 22, 1998

[54] TWO-PIECE CONSTRUCTION BULB SOCKET

[76] Inventor: George Tsai, 4th Fl., No. 403, Sec. 4, Jen-Ai Rd., Taipei, Taiwan

[21] Appl. No.: 800,521

[22] Filed: Feb. 19, 1997

[51] Int. Cl.[6] ..... H01R 17/00

[52] U.S. Cl. ..... 439/619; 439/699.2; 313/318.01

[58] Field of Search ..... 313/318.01; 439/611, 439/613, 619, 699.2

[56] References Cited

U.S. PATENT DOCUMENTS

| | | | |
|---|---|---|---|
| 3,371,306 | 2/1968 | Moranduzzo | 439/619 |
| 5,372,525 | 12/1994 | Wu et al. | 439/699.2 |
| 5,620,343 | 4/1997 | Pan | 439/619 X |
| 5,681,107 | 10/1997 | Wang | 439/699.2 X |

*Primary Examiner*—Khiem Nguyen
*Attorney, Agent, or Firm*—Merchant, Gould, Smith, Edell, Welter & Schmidt, P.A.

[57] ABSTRACT

A bulb socket consisting of an inner piece and a hollow outer piece guidingly receiving the inner piece. The inner piece has a pair of channels for accommodating an electrical connecting wire, a web physically separating the pair of channels and a pair of slits each extending in a respective channel for anchoring a contact blade associated with the electrical connecting wire. The hollow outer piece has a pair of curved recesses complementary in shape to the pair of channels. After the inner and outer pieces are brought together, the pair of channels and the pair of curved recesses form a respective hole formation which securely retain the electrical connecting wires in position, thereby preventing undesired bending of the wires which might lead to short circuit and electrical hazard. The channels and the curved recesses in their modified form are able to accommodate two electrical connecting wires and associated contact blades. The outer piece may optionally be provided with extensions of different length to prevent the wires from undesired repetitive bending at same point. Ridges and annular protrusion may be suitably formed on the outer piece and a groove may be suitably formed on the inner piece to facilitate a firm locking between the inner and outer pieces.

7 Claims, 4 Drawing Sheets

TWO-PIECE CONSTRUCTION BULB SOCKET

BACKGROUND OF THE INVENTION

1. Field of the Invention

The present invention relates to a decorative bulb socket and more particularly to a socket assembly which has a minimum of undesired bending and misplacement of electrical connecting wires connected to the socket assembly.

2. Description of Related Art

Decorative light strings consisting of a series of hollow bulb sockets each with a bulb plug attached thereto are frequently used in holidays or festivals. The bulbs are replaceable and each carried by a corresponding bulb plug.

There is a known type of bulb socket which is made of a single piece. A pair of contact blades with associated electrical connecting wires connected thereto are generally manually pressed, from one end of the socket, onto the inner wall thereof and are then firmly retained in diametrically opposite positions on the inner wall. A bulb plug with a bulb mounted on one end thereof and with a pair of conductive leads of the bulb exposed outside from an opposite end thereof, as is known in this art, is then placed into the other opposite end of the socket. After placement of the bulb plug into the socket, an electrical connection is established between the pair of electrical connecting wires in the socket and the pair of conductive leads of the bulb.

In the above-mentioned type of bulb socket, in order for the contact blades to be firmly retained in position, positioning channels are required to be integrally formed on the inner wall of the socket. With this design, it is not easy to manipulate the contact blades to fit into corresponding positioning channels. Also, since the electrical connecting wires are of a much smaller diameter compared to that of the hollow portion of the socket where the wires and associated contact blades are situated, the wires can be easily displaced within the socket, tending to damage the junction between the wire and associated contact blade or causing the contact blades to move out of their positions. Moreover, the other end of the socket which is opposite to the said one end thereof and where the electrical connecting wires extend out, has a substantially planar end face which together with the inner wall defines an annular edge. The edge serves as fulcrum for undesirable bending of wires which, under repeated folding or bending movement at substantially same positions, may damage the conductors inside the wires.

The present invention aims to provide an improved socket which obviates the disadvantages of the above type of prior bulb socket.

SUMMARY OF THE INVENTION

One object of the present invention is to provide a bulb socket consisted of an inner piece and a hollow outer piece which when engaged to each other define a first and a second hole formations for firmly gripping electrical connecting wires to be connected to the bulb socket.

In accordance with one aspect of the present invention, the inner piece has a web and a pair of side walls joined by the web and the hollow outer piece has an inside wall, the side walls being inclined with respect to each other toward an end of the inner piece and the inside wall having a pair of inclined faces for guidingly engaging the pair of side walls.

In accordance with another aspect of the present invention, a groove may be optionally defined in an outer face of each side wall and a pair of ridges may be correspondingly formed on the inside wall of the hollow outer piece so that the side walls and the inside wall are guidingly engaged.

In accordance with a further aspect of the present invention, a pair of extensions may be provided to protrude from an end face of the hollow outer piece. Advantageously, one of the pair of extensions protrudes a distance different from that of the other extension.

Other objects, advantages and novel features of the invention will become more apparent from the following detailed description when taken in conjunction with the accompanying drawings.

DETAILED DESCRIPTION OF PREFERRED EMBODIMENT

Figure 1:
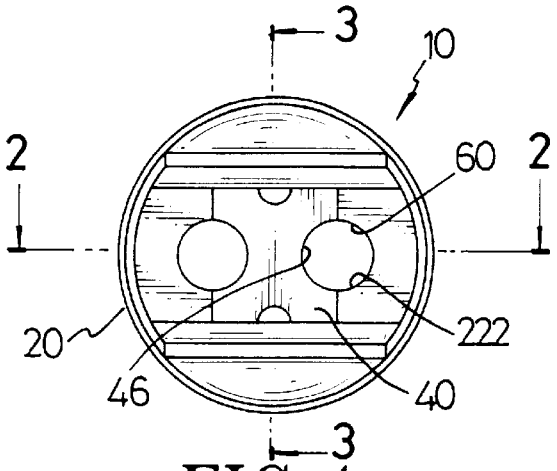
FIG. 1 is a rear view of a bulb socket consisted of an outer piece and an inner piece in accordance with the present invention.

FIG. 1 shows a rear view of a bulb socket 10 constructed in accordance with the present invention. The socket 10 is consisted of an outer piece 20 and an inner piece 40. When in the state of FIG. 1, i.e., the outer piece 20 and the inner piece 40 are brought together to have their end faces flush with each other, a respective hole formation 60 or 62 is formed on either side of the inner piece 40 between the outer and inner pieces 20 and 40 for accommodating corresponding electrical connecting wire or wires (not shown). In one embodiment of the invention, FIGS. 1 through 5 and FIG. 10, the two hole formations 60 and 62 are equal in dimension and shape. In another embodiment of the invention, FIGS. 6 through 8, one of the two hole formations 66 and 68 (FIG. 7), namely the hole formation 68, is formed of a pair of adjacent holes 682 and 684. It is noted that in either embodiment the size and dimension of each single hole formation or each hole in the case of a compound hole formation is determined to be substantially equal to that of the electrical connecting wires to be extended rearward from the rear of the socket 10 (FIG. 1) or 70 (FIG. 7) so that the wires are firmly gripped in the hole formations.

Figure 2:
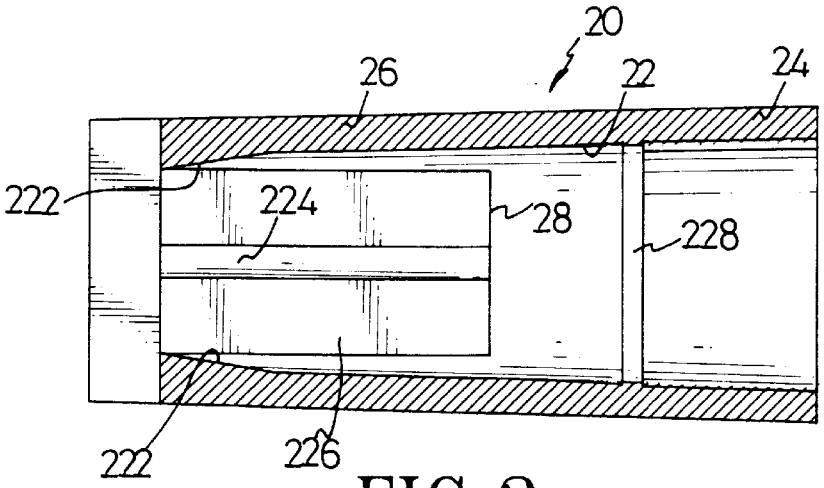
FIG. 2 is a cross section of the outer piece taken along line 2—2 in FIG. 1.
Figure 3:
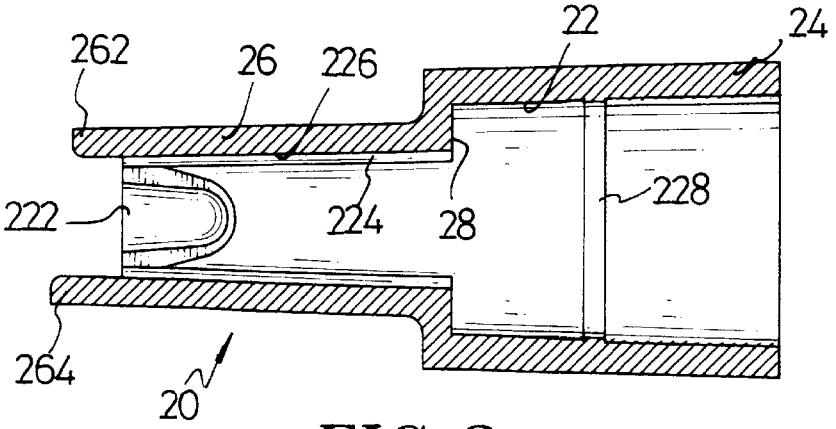
FIG. 3 is another cross section of the outer piece taken along line 3—3 in FIG. 1.
Figure 10:
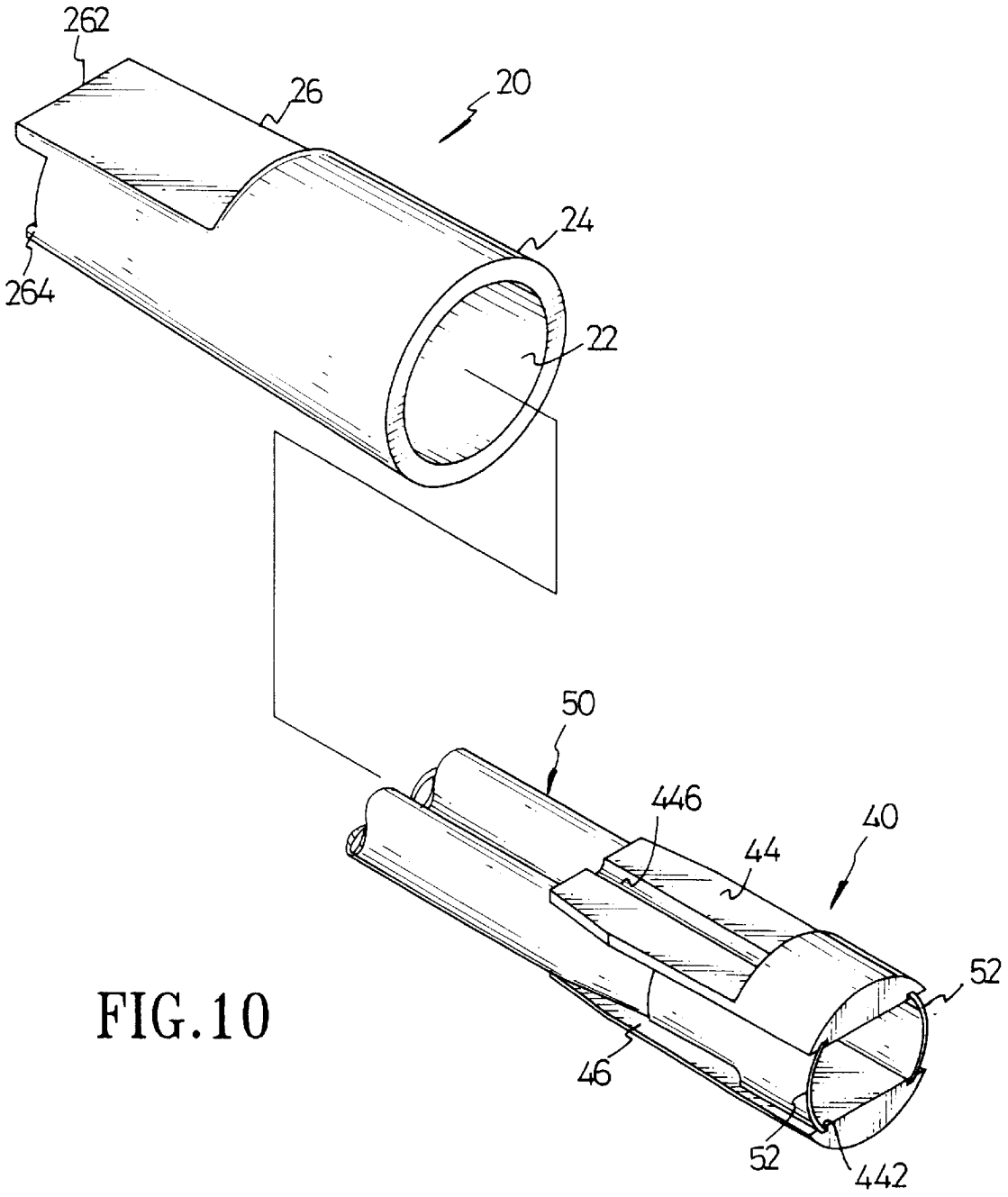
FIG. 10 is an exploded view of the socket of FIG. 1.

Referring to FIGS. 2 and 3 and FIG. 10, the outer piece 20 is of a generally hollow conical shape and has an inside wall 22 and a pair of curved recesses 222 defined in the inside wall 22. From FIG. 1, it can be seen that the curved recess 222 substantially depicts a semi-circle. The outer piece 20 has a front portion 24 one part of which serves as a seat for receiving one part of a known bulb plug (not shown) and the other part of which accommodates a portion of the inner piece 40 which in turn serves as a seat for receiving the other part of the known bulb plug. On the inside wall 22 at a rear portion 26 of the outer piece 20, there is a pair of ridges 224 protruding from a respective planar face 226. A shoulder 28 is formed between each planar face 226 and the inner wall face of the front portion 24.

Figure 4:
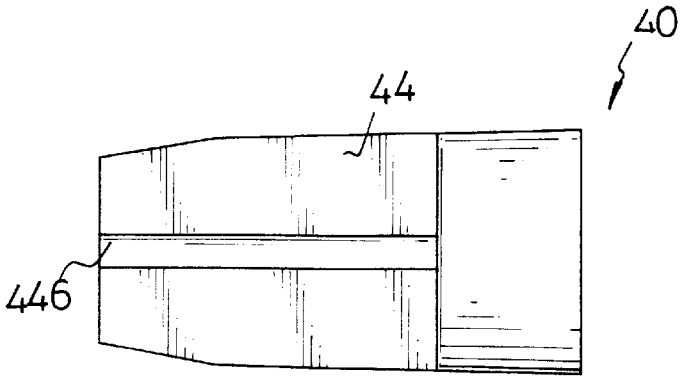
FIG. 4 is a side view of the inner piece.
Figure 5:
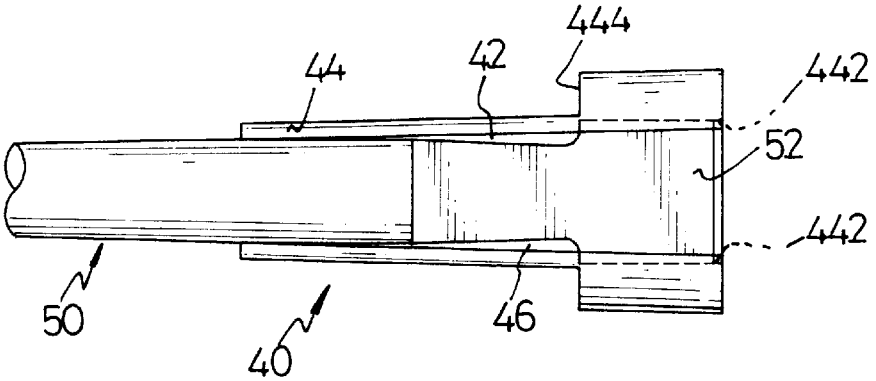
FIG. 5 is another side view of the inner piece and an electrical connecting wire and associated contact blade.
Figure 6:
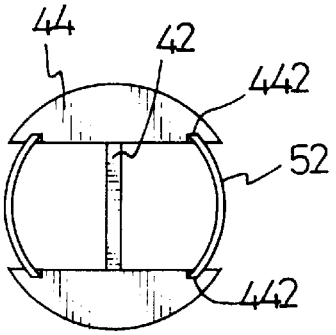
FIG. 6 is a front view of the inner piece and the contact blade.

Referring to FIGS. 4 and 5 and FIG. 10, the inner piece 40 has a web 42 and a pair of side walls 44 joined by the web 42. The web 42 and the pair of side walls 44 together define a pair of channels 46 on two opposite sides of the web 42, as shown in FIGS. 1 and 5. Each side wall 44 has at an end thereof a pair of slits 442 each extending a certain distance in a respective one of the channels 46. Each channel 46 is adapted for accommodating one electrical connecting wire 50 with a respective one of the pair of slits 442 on each side wall 44 in the same channel being adapted for anchoring one contact blade 52 associated with the electrical connecting wire 50. Since the wires 50 in the channels 46 are separated by the web 42, contact of the wires 50 will be effectively reduced or eliminated so that short circuiting or other electrical hazard will not occur. A shoulder 444 is formed on each side wall 44 which, when the inner piece 40 is inserted into the outer piece 20, will bear against the shoulder 28 on the inside wall 22 of the outer piece 20.

In this invention, it can be seen that both the outer piece 20 and the inner piece 40 are of an approximately conical configuration in the aspect that the side walls 44 of the inner piece 40 are inclined with respect to each other toward an end of the inner piece 40 which is distal from the end where the slits 442 are situated and the inside wall 22 of the hollow outer piece 20 has the pair of planar faces 226 which are similarly inclined to each other. The outer piece 20 thus guidingly engages the inner piece 40.

To mate with the pair of ridges 224 on the outer piece 20, a pair of grooves 446 are each defined in an outer face of one side wall 44. The grooves 446 and the ridges 224 facilitate the engagement of the inner piece 40 with the outer piece 20. In addition, there is an annular protrusion 228 (see FIGS. 2 and 3) formed on the inside wall 22 of the outer piece 20 which, once the inner piece 40 and the outer piece 20 are engaged, prevents the inner piece 40 from disengaging the outer piece 20 and thus prevents the contacting blades on the inner piece 40 from inadvertently exposed to outside, even under the situation that external force is applied to the socket. This ensures that the inner piece 40 will be firmly locked to the outer piece 20, thus effectively obviates any electrical hazard such as short circuiting of the contacting blades or electrical connecting wire.

When in the state of FIG. 1, in order to reduce undesired bending which might result in breakage of copper cores constituting the electrical connecting wire, a first and a second extensions 262 and 264 (FIG. 3) are provided to protrude from the end face of the hollow outer piece 20. The provision of the extensions 262 and 264 reduces the likelihood that electrical connecting wires are bent about the flush end faces of the inner and outer pieces 40 and 20. Preferably, one of the first and second extensions 262 and 264 protrudes a distance different from that of the other extension so that the point of bending is not the same to create undesired repetitive effect. Because of this length difference between the two protruding extensions, electrical connecting wires in this invention can endure a one or two times larger bending moment without breakage, thus effectively obviates short circuit which might lead to electrical hazards.

Figure 7:
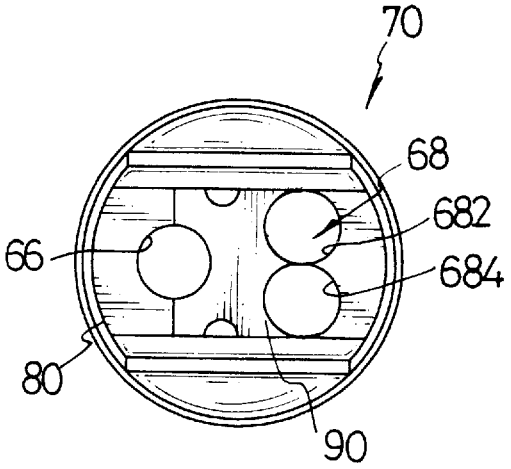
FIG. 7 is a view similar to FIG. 1 but showing a bulb socket in accordance with another embodiment of the present invention.
Figure 8:
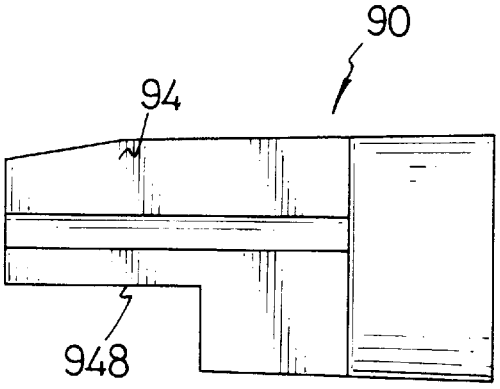
FIG. 8 is a view similar to FIG. 4 but showing the embodiment of FIG. 7.
Figure 9:
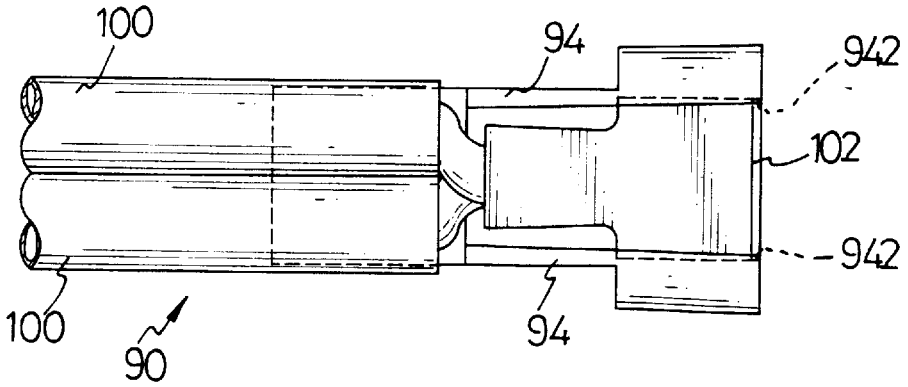
FIG. 9 is a view similar to FIG. 5 but showing the embodiment of FIG. 7.

FIGS. 7 through 9 show another embodiment of the invention in which modification is made to one hole formation 68 to accommodate a pair of electrical connecting wires. As shown in FIG. 7, the hole formation 68 is consisted of a pair of holes 682 and 684. This hole formation 68 is formed by providing part of one of the two channels on the inner piece 90 as a compound channel and a corresponding one of the two curved recesses on the outer piece 80 as a compound recess. The provision of part of one channel as a compound channel for accommodating two electrical connecting wires 100 is made possible by a respective notched portion 948 of the side wall 94. From FIGS. 7 and 9, it can be seen that the two side-by-side electrical connecting wires has a total width approximately equal to a width between the outer faces of the side walls 94. In this embodiment, the contact blades 102 for the two side-by-side electrical connecting wires overlap each other in corresponding slits 942.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A bulb socket comprising:

an inner piece having a web and a pair of side walls joined by the web, the web and the pair of side walls together defining a pair of longitudinal channels on two opposite sides of the web, each side wall having at an end thereof a pair of slits each extending in a respective channel, each channel being adapted for accommodating one or more electrical connecting wires and a respective one of the pair of slits on each side wall in the same channel being adapted for anchoring one or more contact blades associated with the one or more electrical connecting wires, and a hollow outer piece having an inside wall and a pair of curved recesses defined in the inside wall, each of the pair of curved recesses being complementary in shape to a corresponding one of the pair of channels, the inside wall of the hollow outer piece guidingly engaging the pair of side walls of the inner piece, thereby bringing each of the pair of channels and a corresponding one of the pair of curved recesses together to form a respective circular hole formation, each said circular hole formation having a diameter sized to snugly receive one said electrical connecting wire.

2. The bulb socket as claimed in claim 1, further comprising:

a groove defined in an outer face of each side wall, and a pair of ridges formed on the inside wall of the hollow outer piece each for guidingly engaging a corresponding groove.

3. The bulb socket as claimed in claim 1, further comprising a protrusion formed on the inside wall of the hollow outer piece.

4. The bulb socket as claimed in claim 1, further comprising a pair of extensions protruding from an end face of the hollow outer piece and wherein one of the pair of extensions protrudes a distance different from that of the other extension.

5. A bulb socket unit comprising:

an inner piece having a web and a pair of side walls joined by the web, the web and the pair of side walls together defining a pair of longitudinal channels on two opposite sides of the web, each side wall having at an end thereof a pair of slits each extending in a respective channel, one or more electrical connecting wires received by each channel, one or more contact blades associated with the one or more electrical connecting wires being anchored within a respective one of the pair of slits on each side wall in the same channel, and a hollow outer piece having an inside wall and a pair of curved recesses defined in the inside wall, each of the pair of curved recesses being complementary in shape to a corresponding one of the pair of channels, the inside wall of the hollow outer piece guidingly engaging the pair of side walls of the inner piece, thereby bringing each of the pair of channels and a corresponding one of the pair of curved recesses together to form a respective circular hole formation each said circular hole formation having a diameter sized to snugly receive one said electrical connecting wire.

6. The bulb socket unit as claimed in claim 5, further comprising;

a groove defined in an outer face of each side wall, and a pair of ridges formed on the inside wall of the hollow outer piece each for guidingly engaging a corresponding groove.

7. The bulb socket unit as claimed in claim 5, further comprising a pair of extensions protruding from an end face of the hollow outer piece and wherein one of the pair of extensions protrudes a distance different from that of the other extension.

* * * * *